US009691325B2

(12) United States Patent
Park et al.

(10) Patent No.: US 9,691,325 B2
(45) Date of Patent: Jun. 27, 2017

(54) DISPLAY DEVICE

(71) Applicant: SAMSUNG DISPLAY CO., LTD., Yongin, Gyeonggi-Do (KR)

(72) Inventors: Kyong Tae Park, Suwon-si (KR); Ji Yong Park, Yongin-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 9 days.

(21) Appl. No.: 14/643,377

(22) Filed: Mar. 10, 2015

(65) Prior Publication Data

US 2016/0104423 A1 Apr. 14, 2016

(30) Foreign Application Priority Data

Oct. 13, 2014 (KR) ..... 10-2014-0137708

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0251* (2013.01); *G09G 2320/0223* (2013.01); *G09G 2320/045* (2013.01)

(58) Field of Classification Search
CPC ..... G09G 2300/0819; G09G 2300/0842
See application file for complete search history.

(56) References Cited

U.S. PATENT DOCUMENTS

| | | | | |
|---|---|---|---|---|
| 7,414,599 | B2 | 8/2008 | Chung et al. | |
| 7,903,057 | B2 | 3/2011 | Uchino et al. | |
| 8,325,176 | B2 | 12/2012 | Toyomura et al. | |
| 2007/0262931 | A1* | 11/2007 | Peng | G09G 3/3233 345/76 |
| 2008/0048947 | A1* | 2/2008 | Liu | G09G 3/3233 345/77 |
| 2008/0048949 | A1* | 2/2008 | Kim | G09G 3/3233 345/80 |
| 2009/0231304 | A1* | 9/2009 | Lee | G02F 1/13338 345/174 |
| 2014/0333599 | A1* | 11/2014 | Lee | G09G 3/3291 345/212 |

FOREIGN PATENT DOCUMENTS

| | | |
|---|---|---|
| JP | 2009-216984 | 9/2009 |
| KR | 10-2005-0084509 A | 8/2005 |

(Continued)

*Primary Examiner* — Van Chow
(74) *Attorney, Agent, or Firm* — Lee & Morse, P.C.

(57) ABSTRACT

A display device includes a plurality of pixels and a compensation power supply line. The pixels are located at intersections of data lines and gate lines. The compensation power supply line is separated from the data lines. Each of the pixels includes an in-pixel circuit and at least one out-pixel circuit. The in-pixel circuit includes a first transistor, to be controlled based on a data voltage from a corresponding one of the data lines, and a storage capacitor connecting the first transistor and a first node. The at least one out-pixel circuit receives a compensation voltage from the compensation power supply line and provides the compensation voltage to the first node.

9 Claims, 19 Drawing Sheets

(56) References Cited

FOREIGN PATENT DOCUMENTS

| | | | |
|---|---|---|---|
| KR | 10-2012-0002070 | A | 1/2012 |
| KR | 10-2012-0009904 | A | 2/2012 |
| KR | 10-2012-0044502 | A | 5/2012 |
| KR | 10-2013-0024744 | A | 3/2013 |
| KR | 10-2014-0029795 | A | 3/2014 |

* cited by examiner

DISPLAY DEVICE

CROSS-REFERENCE TO RELATED APPLICATION

Korean Patent Application No. 10-2014-0137708, filed on Oct. 13, 2014, and entitled, "Display Device," is incorporated by reference herein in its entirety.

BACKGROUND

1. Field

One or more embodiments described herein relate to a display device.

2. Description of the Related Art

A display may be classified as a passive matrix display or an active matrix display according to its driving method. An active matrix display is suitable for large-area displays because it consumes less power and has higher resolution than a passive matrix display. Also, an active matrix display includes a pixel driving circuit connected to a liquid crystal capacitor or a light-emitting diode.

Examples of these displays include liquid crystal displays, electrophoretic displays, organic light-emitting displays, inorganic electroluminescent displays, field emission displays, surface-conduction electron-emitter displays, plasma displays, and cathode ray tube displays.

Organic light-emitting displays display images, characters, and other information based on pixels that emit light based on a combination of holes and electrons in an organic layer. In operation, the intensity of current flowing through an electroluminescent (EL) element of each pixel may change over time, thereby causing a display non-uniformity. This is because the current flowing through the EL element may change because of a change in the threshold voltage of the driving transistor.

The threshold voltage of a driving transistor may change, for example, based on various manufacturing process variables. Therefore, it may be difficult to manufacture driving transistors having equal threshold voltages in an active matrix display. This will result in a threshold voltage difference among the pixels.

SUMMARY

In accordance with one embodiment, a display device includes a plurality of data lines in a first direction; a plurality of gate lines in a second direction; a plurality of pixels at intersections of the data lines and gate lines; and a compensation power supply line in the first direction and separated from the data lines, wherein each of the pixels includes: an in-pixel circuit including a first transistor, to be controlled based on a data voltage from a corresponding one of the data lines, and a storage capacitor connecting the first transistor and a first node, and at least one out-pixel circuit to receive a compensation voltage from the compensation power supply line and to provide the compensation voltage to the first node.

The in-pixel circuit may include a second transistor to deliver the data voltage applied to the corresponding one of the data lines to a second node based on a first input signal; a third transistor to apply a voltage of the first transistor and a voltage of a third node based on an emission control signal; and an organic light-emitting diode connected to the third node.

The in-pixel circuit may include a fourth transistor to apply a common power supply voltage to the third node based on a second input signal; and a fifth transistor to apply the common power supply voltage to the second node based on to the second input signal. A phase of the first input signal may be later than a phase of the second input signal by substantially two horizontal periods.

The at least one out-pixel circuit may include a first compensation transistor to provide a pixel power supply voltage to the first node in response to the emission control signal; and a second compensation transistor to deliver the compensation voltage applied to the compensation power supply line to the first node.

The display device may include a unit pixel including two or more of the pixels; and a horizontal compensation line in the second direction and electrically connected to the unit pixel. The unit pixel may include a compensation power supply line and one out-pixel circuit.

The display device may include a horizontal compensation line in the second direction and electrically connected to the unit pixel; and a first out-pixel circuit and a second out-pixel circuit at ends of the horizontal compensation line and connected to the compensation power supply line. The first out-pixel circuit may include a third compensation transistor to provide the compensation voltage applied to the compensation power supply line to the horizontal compensation line based on the first input signal, and the second out-pixel circuit may include a fourth compensation transistor to provide the compensation voltage applied to the compensation power supply line to the horizontal compensation line based on the first input signal.

In accordance with another embodiment, a display device may include a plurality of data lines in a first direction; a plurality of gate lines in a second direction; a plurality of pixels at intersections of the data lines and the gate lines; a compensation power supply line in the first direction and separated from the data lines; and an initialization power supply line in the first direction and separated from the data lines and the compensation power supply line, wherein each of the pixels includes: an in-pixel circuit including a first transistor, to be controlled by a data voltage from a corresponding one of the data lines, and a storage capacitor connecting the first transistor and a first node; and at least one out-pixel circuit to receive a compensation voltage from the compensation power supply line and to provide the compensation voltage to the first node.

The in-pixel circuit may include a second transistor to deliver the data voltage applied to the corresponding data line to a second node based on a first input signal; a third transistor to apply a voltage of the first transistor and a voltage of a third node based on an emission control signal; and an organic light-emitting diode connected to the third node.

The in-pixel circuit may include a fourth transistor to apply an initialization voltage to the third node based on a second input signal; and a fifth transistor to apply the initialization voltage to the second node based on the second input signal. A phase of the first input signal may be later than a phase of the second input signal by substantially two horizontal periods.

The at least one out-pixel circuit may include a first compensation transistor to provide a pixel power supply voltage to the first node based on the emission control signal; and a second compensation transistor to deliver the compensation voltage applied to the compensation power supply line to the first node.

The display device may include a unit pixel including two or more of the pixels; and a horizontal compensation line in the second direction and electrically connected to the unit pixel, wherein the unit pixel includes one compensation power supply line and one out pixel. The display device may include a horizontal compensation line in the second direction and electrically connected to the unit pixel; and a first out-pixel circuit and a second out-pixel circuit at ends of the horizontal compensation line and connected to the compensation power supply line, wherein the first out-pixel circuit includes a third compensation transistor to provide the compensation voltage applied to the compensation power supply line to the horizontal compensation line based on the first input signal, and wherein the second out-pixel circuit includes a fourth compensation transistor to provide the compensation voltage applied to the compensation power supply line to the horizontal compensation line based on the first input signal.

In accordance with another embodiment, a display device includes a plurality of data lines in a first direction; a plurality of gate lines in a second direction; a plurality of pixels at intersections of the data lines and the gate lines; a compensation power supply line in the first direction and separated from the data lines; and an initialization power supply line in the first direction and separated from the data lines and the compensation power supply line, wherein each of the pixels includes: an in-pixel circuit including a first transistor, to be controlled by a data voltage received from a corresponding one of the data lines, and a storage capacitor connecting the first transistor and a first node; at least one out-pixel circuit to receive a compensation voltage from the compensation power supply line and to provide the compensation voltage to the first node; and a sensor connected to the initialization power supply line.

The in-pixel circuit may include a second transistor to deliver the data voltage applied to the corresponding one of the data lines to a second node based on a first input signal; a third transistor to apply a voltage of the first transistor and a voltage of a third node based on an emission control signal; and an organic light-emitting diode connected to the third node.

The in-pixel circuit may include a fourth transistor to apply an initialization voltage to the third node based on a second input signal; and a fifth transistor to apply the initialization voltage to the second node based on the second input signal.

The at least one out-pixel circuit may include a first compensation transistor to provide a pixel power supply voltage to the first node based on the emission control signal; and a second compensation transistor to deliver the compensation voltage applied to the compensation power supply line to the first node.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
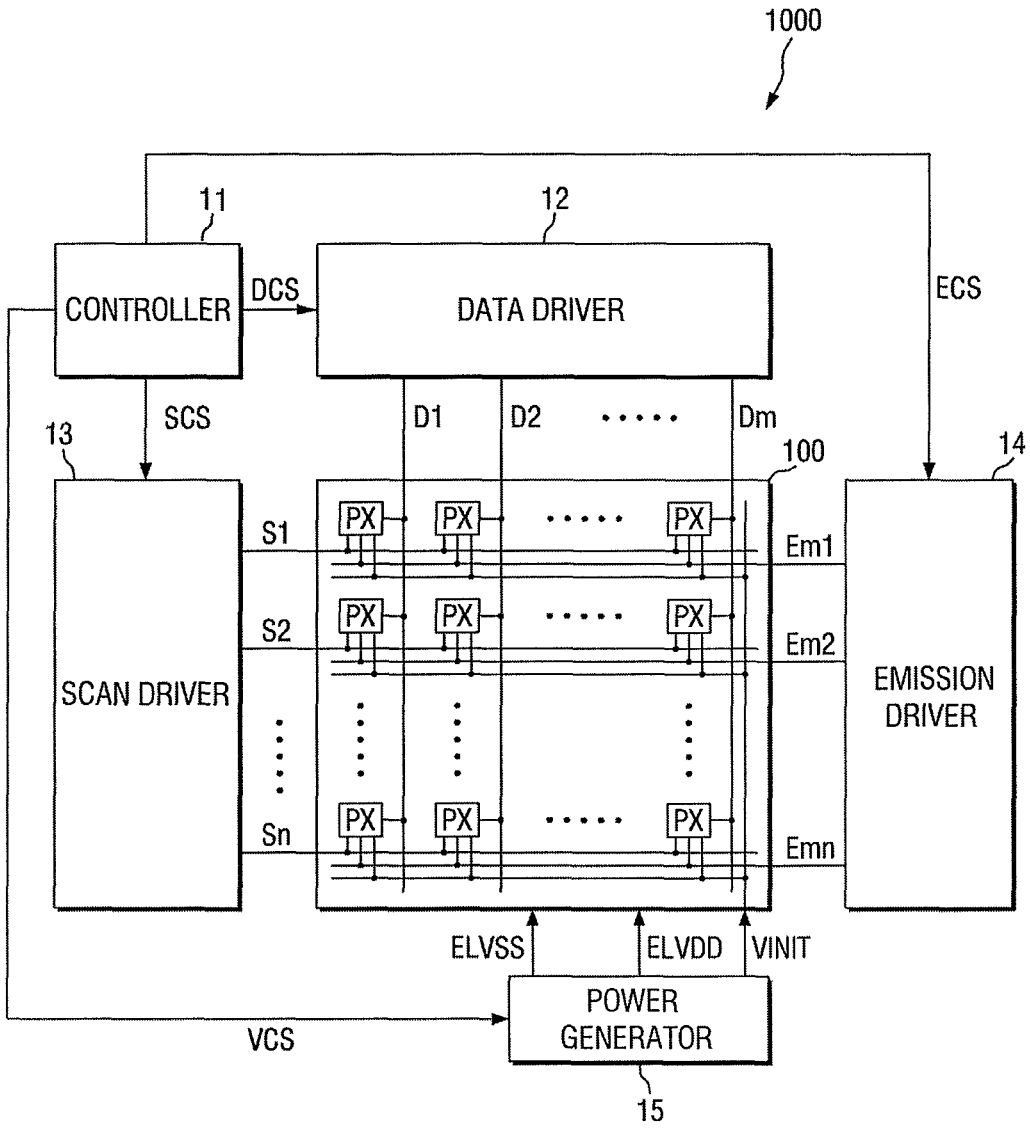
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

It will be understood that when an element or layer is referred to as being "on," or "connected to" another element or layer, it can be directly on or connected to the other element or layer or intervening elements or layers may be present. In contrast, when an element is referred to as being "directly on" or "directly connected to" another element or layer, there are no intervening elements or layers present. As used herein, the term "and/or" includes any and all combinations of one or more of the associated listed items.

FIG. 1 illustrates an embodiment of a display device 1000 which includes a display panel 100. The display device 1000 may be an organic light-emitting display or another type of display device.

The display panel 100 includes lines for delivering signals to pixels PX arranged in a matrix. Each of the pixels PX may emit, for example, one of red, green, or blue light. The light emission of the pixels PX may be controlled by first through $n^{th}$ scan signals S1 through Sn, first through $m^{th}$ data signals D1 through Dm, and first through $n^{th}$ emission control signals EM1 through EMn transmitted from external sources. The first through $n^{th}$ scan signals S1 through Sn may control whether the pixels PX will receive the first through $m^{th}$ data signals D1 through Dm, respectively. The first through $m^{th}$ data signals D1 through Dm may include information indicative of luminances of light that the pixels PX will respectively emit. The first through $n^{th}$ emission control signals EM1 through EMn may control the light emission of the pixels PX, respectively.

The lines may include lines for delivering the first through $n^{th}$ scan signals S1 through Sn, the first through $m^{th}$ data signals D1 through Dm, the first through $n^{th}$ emission control signals EM1 through EMn, and an initialization voltage VINIT. The lines for delivering the first through $n^{th}$ scan signals S1 through Sn and the first through $n^{th}$ emission control signals EM1 through EMn may extend along a row direction of the pixels PX. The lines for delivering the first through $m^{th}$ data signals D1 through Dm may extend along a column direction of the pixels PX. The lines for delivering the initialization voltage VINIT may extend along the row direction of the pixels PX. The lines for delivering the initialization voltage VINIT may be formed in a zigzag pattern. The lines may arranged in different directions and/or in a different manner in other embodiments.

The display device 1000 may further include a driving unit and a power generator 15. The driving unit may include a controller 11, a data driver 12, a scan driver 13, and an emission controller 14. The controller 11 may receive image data from an external source and generate a scan driver control signal SCS for controlling the scan driver 13, a data driver control signal DCS for controlling the data driver 12, and an emission driver control signal ECS for controlling the emission driver 14 based on the received image data.

The data driver 12 may receive the data driver control signal DCS and generate the first through $m^{th}$ data signals D1 through Dm based on the data driver control signal DCS.

The scan driver 13 may receive the scan driver control signal SCS and generate the first through $n^{th}$ scan signals S1 through Sn based on the scan driver control signal SCS.

The emission driver 14 may receive the emission driver control signal ECS and generate the first through $n^{th}$ emission control signals EM1 through EMn based on the emission driver control signal ECS.

The power generator 15 may generate the initialization voltage VINIT, a first power supply voltage ELVDD, and a second power supply voltage ELVSS, and may provide the initialization voltage VINIT, the first power supply voltage ELVDD, and the second power supply voltage ELVSS to the display panel 100. In one embodiment, the initialization voltage VINIT, the first power supply voltage ELVDD, and the second supply voltage ELVSS are variable, and the controller 11 may control the power generator 15 to vary the initialization voltage VINIT, the first power supply voltage ELVSS, and the second power supply voltage ELVSS.

Figure 2:
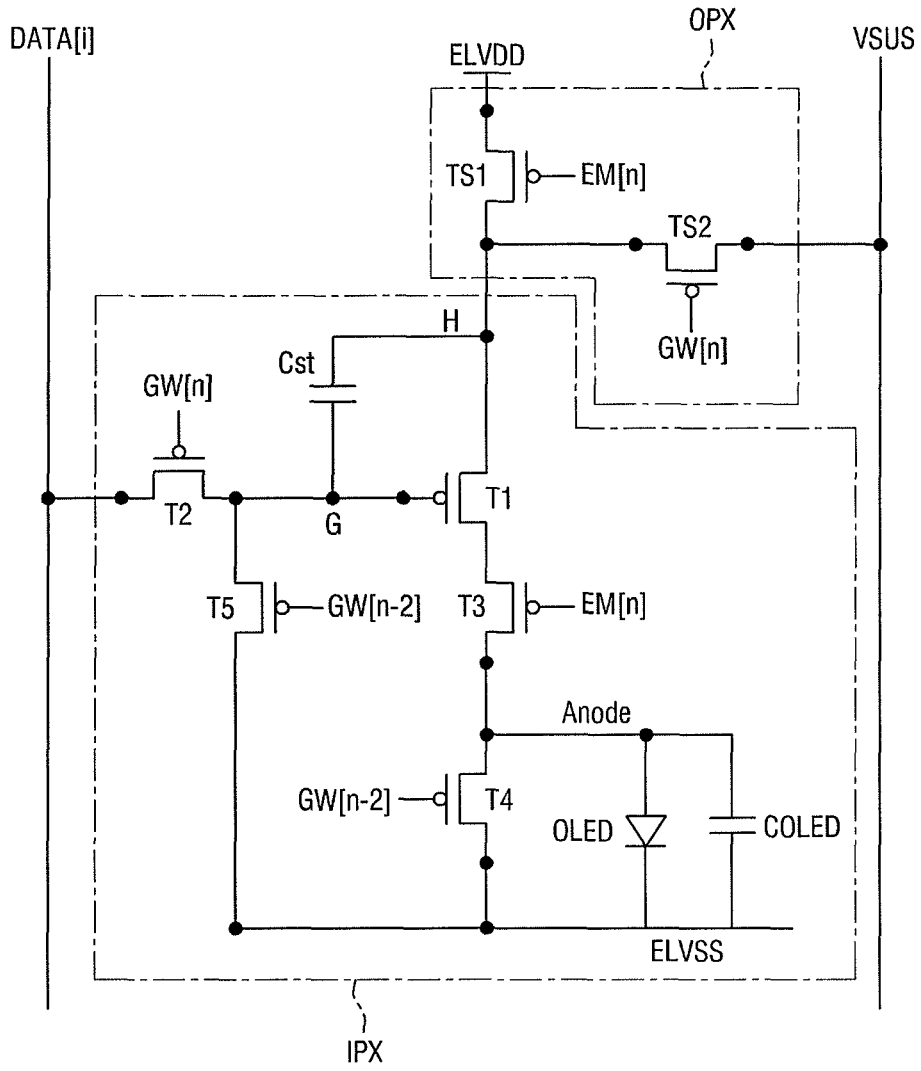
FIG. 2 illustrates an embodiment of a pixel.

FIG. 2 illustrates an embodiment of a pixel of the display device 1000. Referring to FIG. 2, the pixel of the display device 100 may include an in-pixel circuit IPX and an out-pixel circuit OPX. The in-pixel circuit IPX may include a plurality of thin-film transistors (TFTs) (T1 through T5) to which a plurality of signals may be transmitted, a storage capacitor Cst, and an organic light-emitting diode OLED. The out-pixel circuit OPX may include a first compensation transistor TS1 and a second compensation transistor TS2 to which a plurality of signals may be transmitted.

The in-pixel circuit IPX may be connected to a data line extending in a first direction (e.g., the column direction), and the out-pixel circuit OPX may be connected to a compensation power supply line VSUS extending in the first direction and separated from the data line.

The TFTs in the in-pixel circuit IPX may include a first TFT T1 (a driving TFT), a second TFT T2 (a switching TFT), a third TFT T3, a fourth TFT T4, and a fifth TFT T5. The signals may include a first scan signal GW[n], a second scan signal GW[n−2], an emission control signal EM[n], a data signal (or voltage) DATA[i], the first power supply voltage ELVDD, the second power supply voltage ELVSS, and a compensation voltage VS.

The first TFT T1 may have a gate electrode connected to a terminal of the storage capacitor Cst, a source electrode connected to the first supply voltage ELVDD via the first compensation transistor TS1, and a drain electrode electrically connected to an anode of the organic light-emitting diode OLED at a second electrode (e.g., Anode) via the third TFT T3. The first TFT T1 may receive the data signal DATA[i] according to a switching operation of the second TFT T2 and supply a driving current to the organic light-emitting diode OLED.

The second TFT T2 may have a gate electrode receiving the first scan signal GW[n], a source electrode receiving the data signal DATA[i], and a drain electrode connected to the source electrode of the first TFT T1 and receiving the first power supply voltage ELVDD via the first compensation transistor TS1. The second TFT T2 may be turned on by the first scan signal GW[n] to perform a switching operation of delivering the data signal DATA[i] to the source electrode of the first TFT T1.

The third TFT T3 may have a gate electrode receiving the emission control signal EM[n], a source electrode connected to the drain electrode of the first TFT T1, and a drain electrode electrically connected to the Anode of the organic light-emitting diode OLED and a drain electrode of the fourth TFT T4 at the anode. The third TFT T3 delivers the driving current of the first TFT T1 to the organic light-emitting diode OLED in response to the emission control signal EM[n].

The fourth TFT T4 may have a gate electrode receiving the second scan signal GW[n−2], a source electrode receiving the second power supply voltage ELVSS, and the drain electrode electrically connected to the drain electrode of the third TFT T3 and the anode of the organic light-emitting diode OLED at the Anode. The fourth TFT T4 may be turned on by the second scan signal GW[n−2] to deliver the second power supply voltage ELVSS to the anode of the organic light-emitting diode OLED. Accordingly, electric charges in a capacitor of the organic light-emitting diode OLED may be removed, thereby preventing weak light emission due to a leakage current.

The fifth TFT T5 may have a gate electrode receiving the second scan signal GW[n−2], a source electrode receiving the second power supply voltage ELVSS, and a drain electrode connected to a first node (Gnode) so as to remove electric charges from the storage capacitor Cst. Accordingly, a voltage corresponding to the data signal DATA[i] may be delivered to the gate electrode of the first TFT T1.

The first scan signal GW[n] and the second scan signal GW[n−2] do not include a section in which low-level voltages overlap each other, and a phase of the first scan signal GW[n] may be later than that of the second scan signal GW[n−2] by one horizontal period (1H).

The first compensation transistor TS1 may have a gate electrode receiving the emission control signal EM[n], a source electrode receiving the first power supply voltage ELVDD, and a drain electrode connected to the source electrode of the first TFT T1 and the drain electrode of the second compensation transistor TS2 at a third node (Hnode).

The second compensation transistor TS2 may have a gate electrode receiving the first scan signal GW[n], a source electrode receiving the compensation voltage VSUS, and a drain electrode connected to the source electrode of the first TFT T1 and the drain electrode of the first compensation transistor TS1 at the Hnode.

The data voltage DATA[i] supplied through the data line is applied to Gnode at a time when the first scan signal GW[n] has a low level. At this time, the compensation voltage VSUS is also applied to the Hnode via the second compensation transistor TS2. Accordingly, a difference (VSUS−DATA[i]) between the compensation voltage VSUS and the data voltage DATA[i] is stored in the storage capacitor Cst. The first compensation transistor TS1 is turned on in response to the emission control signal EM[n] at a low level to provide the first power supply voltage ELVDD to the Hnode. The first TFT T1 is turned on by the voltage of Hnode to allow the driving current to flow. The voltage of Gnode may compensate for a dynamic voltage (IR) drop of the first power supply voltage ELVDD while following the first power supply voltage ELVDD.

Various internal compensation circuits been proposed. These circuits may compensate for the threshold voltage Vth, mobility, and hysteresis of a driving transistor, may increase resistance (or current) of an organic light-emitting diode OLED, producing an IR drop of the first power supply voltage ELVDD, and provide a contrast ratio due to leakage current. However, these internal compensation circuits have limitations in compensating for reduction in the efficiency of the organic light-emitting diode OLED, the threshold voltage Vth of the driving transistor in the case of high resolution, and a reduction in data transfer rate due to a reduction of 1H.

For example, in the case where data writing and threshold voltage compensation occur simultaneously, the time required for data writing may be equal to the time required for threshold voltage compensation time. Therefore, a reduction of 1H leads to a reduction in the time required for threshold voltage compensation. However, since the reduction in the time required for threshold voltage compensation increases compensation current, it may be difficult to accurately compensate for the threshold voltage Vth, for example, at low gray levels.

In addition, since the first TFT T1 is "diode-connected," it may be difficult to utilize an overlap-scan driving method, that have proven useful in the case of a reduction of 1H in other circumstances. In the overlap-scan driving method, scan signals GW[n−1] and GW[n+1] transmitted before and after the first scan signal GW[n] partially overlap the first scan signal GW[n]. Non-utilization of the overlap-scan driving method may reduce the efficiency of data writing.

In the present embodiment, since the compensation power supply line VSUS is connected to Hnode, the compensation voltage VSUS may be stably applied to the storage capacitor Cst. In addition, since the first scan signal GW[n] and the second scan signal GW[n−2] are transmitted to one pixel, data writing and threshold voltage compensation may be performed during 2H. Driving principles according to this embodiment will be described in greater detail with reference to FIG. 3.

Figure 3:
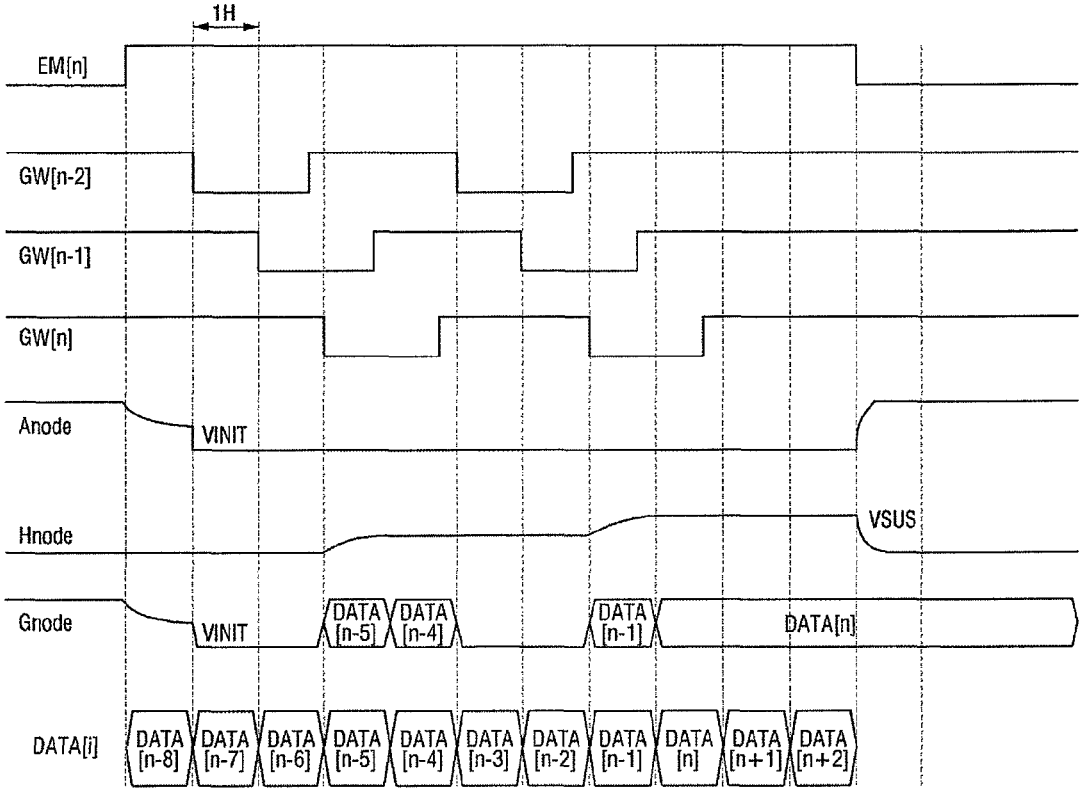
FIG. 3 illustrates an operation timing embodiment of the display device.

FIG. 3 is a timing diagram illustrating an operation timing embodiment of the display device 1000. Referring to FIG. 3, while the emission control signal EM[n] maintains a high-level voltage, a gate-on voltage (i.e., a low-level voltage) of each of the first scan signal GW[n], the second scan signal GW[n−2], and the third scan signal GW[n−1] may be applied. The first scan signal GW[n] has been shifted from the third scan signal GW[n−1] by 1H and shifted from the second scan signal GW[n−2] by 2H. Each scan signal may maintain a low-level voltage for a period shorter than 2H and may include a section that maintains a plurality of low-level voltages. In the current embodiment, a driving method is described using a case where each scan signal includes a section that maintains two low-level voltages. However, each scan signal may also include a section that maintains two or more low-level voltages in another embodiment.

The gate-on voltage of each scan signal may be maintained for 2H in order to prevent a reduction in the charging rate of the storage capacitor Cst due to a resistive-capacitive (RC) delay.

When the emission control signal EM[n] rises to a gate-off voltage (i.e., a high-level voltage), the third TFT T3 is turned off. Thus, the driving current is not provided, thereby causing the voltage level of Anode to fall gradually. Then, at a time when the voltage of the second scan signal GW[n−2] falls to the gate-on voltage (i.e., a low level), the voltage of Anode falls to the second power supply voltage ELVSS and is maintained at the second power supply voltage ELVSS. The voltage of Anode begins to rise from a time when the emission control signal EM[n] falls to a low level and is then maintained at a constant level.

The voltage level of Hnode rises whenever the first scan signal GW[n] has a low level and begins to fall to the level of the compensation voltage VSUS at a time when the emission control signal EM[n] has a low-level voltage.

At a time when the first scan signal GW[n] falls to the gate-on voltage (i.e., a low-level voltage), the data voltage DATA[i] may be applied to Gnode. For example, the voltage of Gnode is initialized to a low voltage such as the second power supply voltage ELVSS, and then first and second data voltages DATA[n−5] and DATA[n−4] are applied to Gnode. The voltage of Gnode falls again to the second power supply voltage ELVSS at a time when the voltage level of the second scan signal GW[n−2] falls to the gate-on voltage. In addition, when the first scan signal GW[n] falls to the gate-on voltage, a third data voltage DATA[n−1] is applied to Gnode. Accordingly, the hysteresis of the first TFT T1 may be restored and the data voltage DATA[i] may be finally stored.

Figure 4:
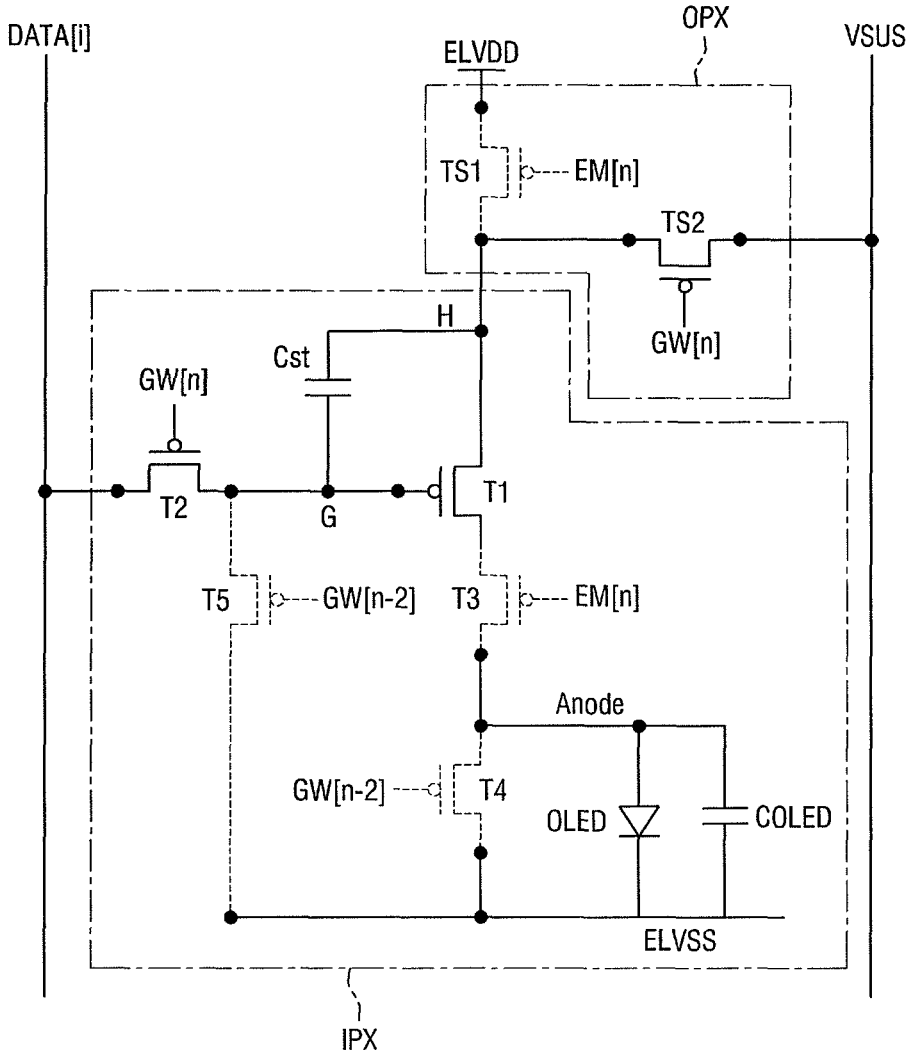
FIGS. 4 and 5 illustrate an example of the operation of the circuit of FIG. 2.
Figure 5:
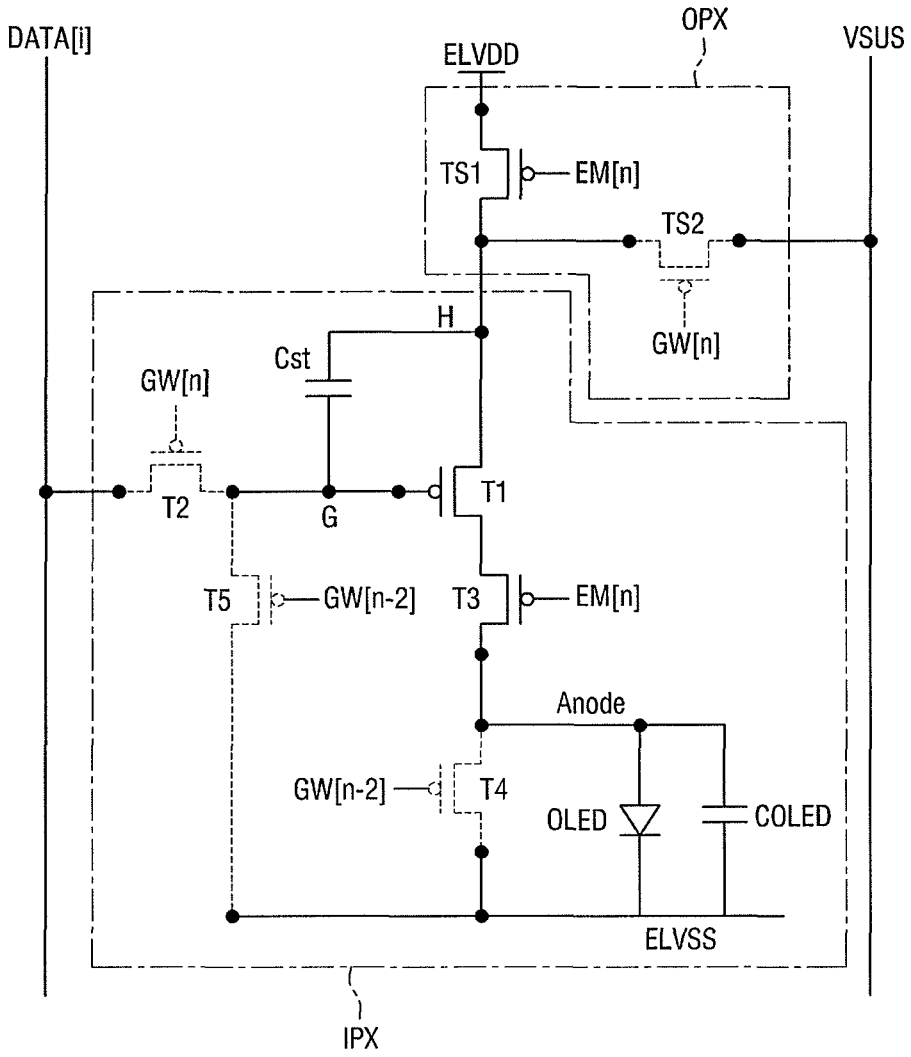

FIGS. 4 and 5 illustrating an example of the operation of the circuit of FIG. 2.

Referring to FIG. 4, when the voltage level of the emission control signal EM[n] rises to a high level and when the voltage level of the first scan signal GW[n] falls to a low level, the third through fifth TFTs T3 through T5 and the first compensation transistor TS1 are turned off.

The second TFT T2 is turned on in response to the first scan signal GW[n] to provide the data voltage DATA[i] to Gnode, and a voltage corresponding to the data voltage DATA[i] is stored in the storage capacitor Cst connected to Gnode. The second compensation transistor TS2 is also turned on in response to the first scan signal GW[n] to apply the compensation voltage VSUS to Hnode. The voltage stored in the storage capacitor Cst may correspond to a difference (VSUS−DATA[i]) between the compensation voltage VSUS and the data voltage DATA[i].

Referring to FIG. 5, when the voltage level of the emission control signal EM[n] falls to a low level and when the voltage level of the first scan signal GW[n] rises to a high level, the second, fourth and fifth TFTs T2, T4, and T5 and the second compensation transistor TS2 are turned off.

As the third TFT T3 is turned on, the driving current of the first TFT T1 is delivered to the anode of the organic light-emitting diode OLED. Accordingly, the organic light-emitting diode OLED emits light. However, as the first compensation transistor TS1 is turned on, the voltage of Hnode is changed to the first power supply voltage ELVDD, and the voltage of Gnode is also changed according to the first power supply voltage ELVDD. Therefore, an IR drop of the first power supply voltage ELVDD may be compensated.

Figure 6:
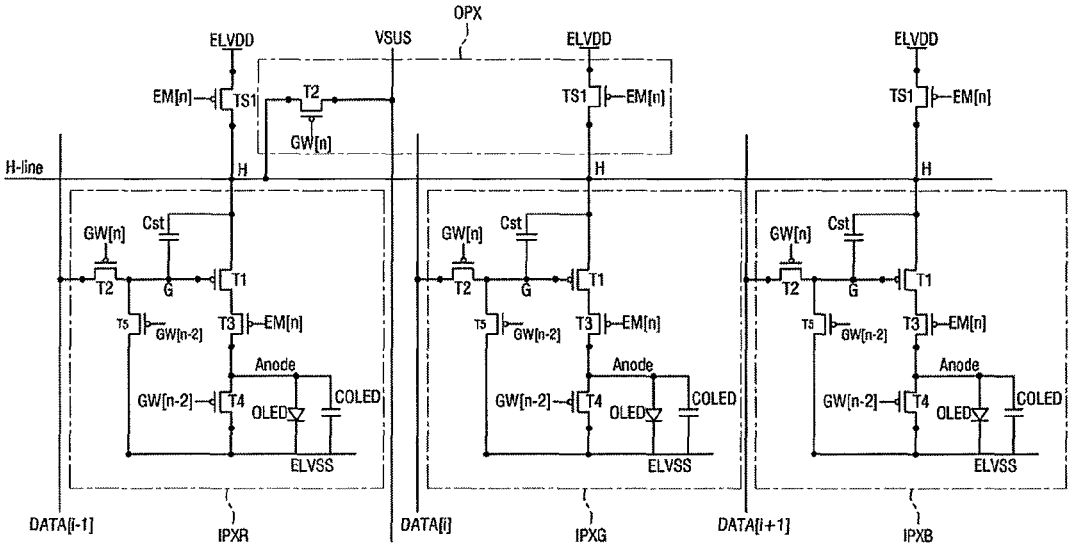
FIG. 6 illustrates an embodiment of a unit pixel.

FIG. 6 illustrates an equivalent circuit of an embodiment of a unit pixel of the display device 1000. Referring to FIG. 6, the unit pixel of the display device 1000 includes R, G, and B pixels.

An H line may extend in the first direction of the unit pixel and may be electrically connected to in-pixel circuits IPXR, IPXG and IPXB of the R, G and B pixels. The H line passes through a plurality of unit pixels, and one out pixel OPX may be included in each unit pixel. In another embodiment, the out pixel OPX may be in one or more subpixels (e.g., R, G, B, and W pixels).

Since the H line and a line to which the first power supply voltage ELVDD is applied have different voltages, they may be separated from each other. During data writing, the storage capacitor Cst should be charged while an IR drop of the first power supply voltage ELVDD is compensated. Therefore, to secure a sufficient charging time, a scan signal having the gate-on voltage maintained for 2H may be transmitted a plurality of times.

Figure 7:
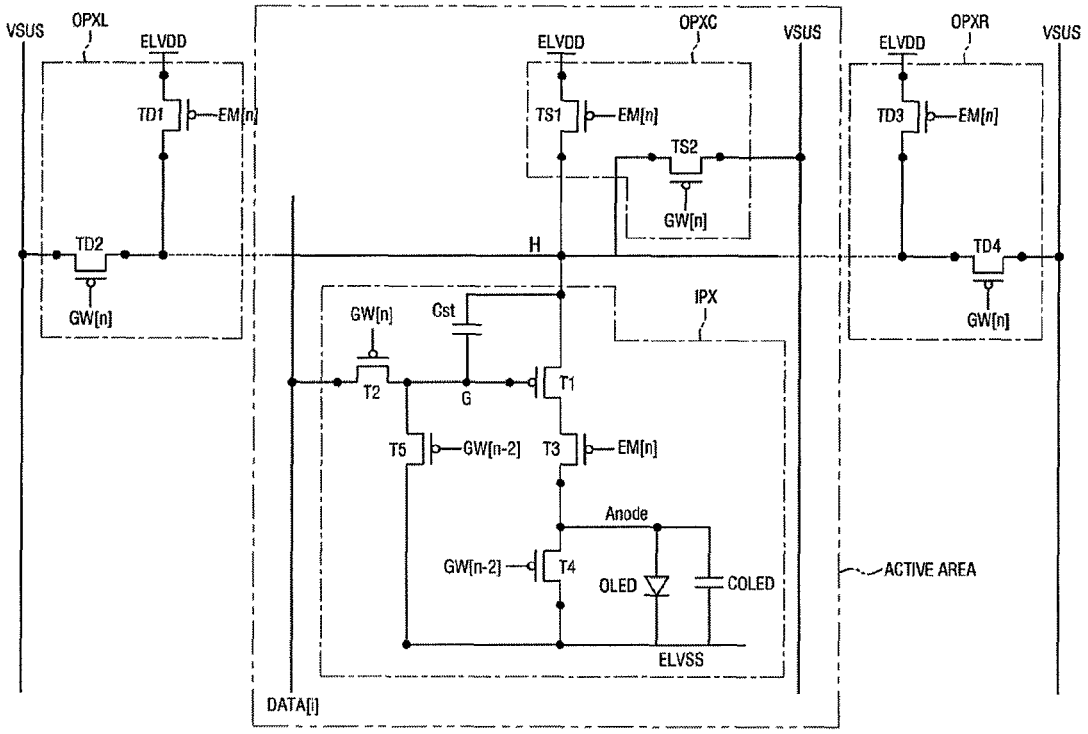
FIG. 7 illustrates an embodiment of compensation power supply lines and a unit pixel of the display device.

FIG. 7 illustrates an equivalent circuit of an embodiment of compensation power supply lines and a unit pixel of the display device 1000. Referring to FIG. 7, a first out pixel OPXL and a second out pixel OPXR electrically connected to the H line may be located on respective sides of the panel 100 of the display device 1000. The first out pixel OPXL may include third and fourth compensation transistors TD1 and TD2 which apply the compensation voltage VSUS to the H line in response to the emission control signal EM[n]. The second out pixel OPXR may include fifth and sixth compensation transistors TD3 and TD4 which apply the compensation voltage VSUS to the H line in response to the emission control signal EM[n]. By adding the first out pixel OPXL and the second out pixel OPXR to both sides of the H line, the compensation voltage VSUS may be applied more efficiently to the H line.

Figure 8:
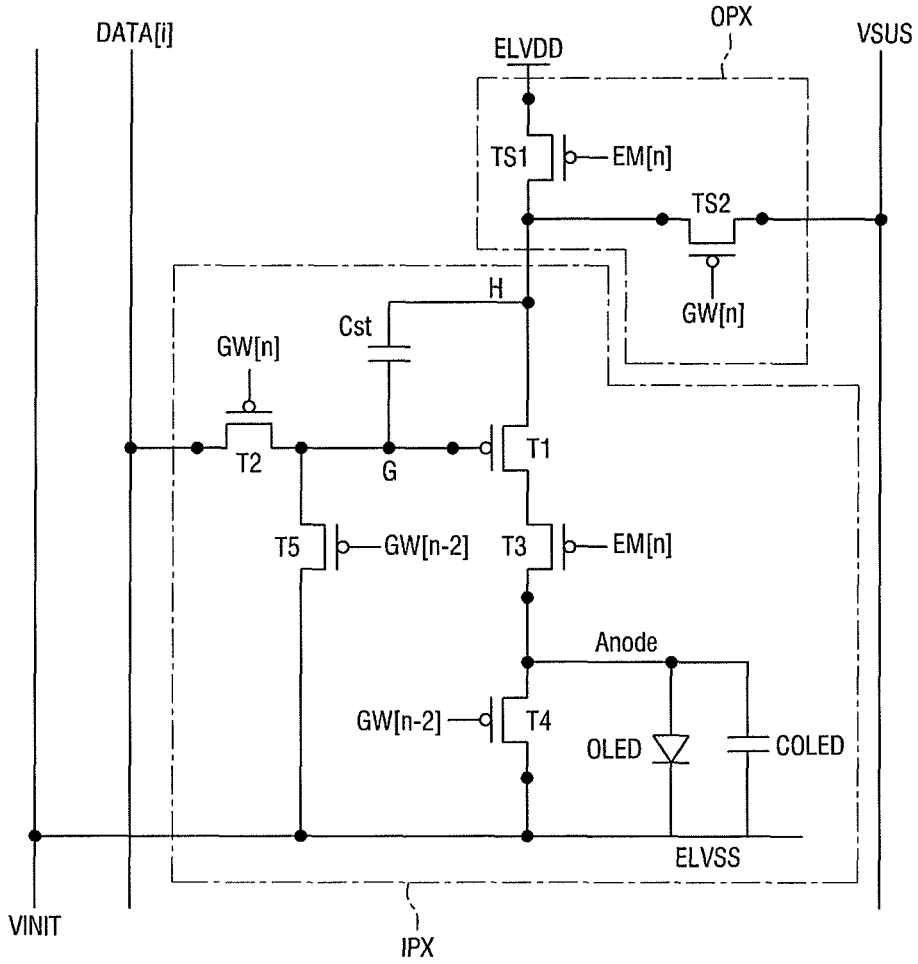
FIG. 8 illustrates another embodiment of a unit pixel.
Figure 9:
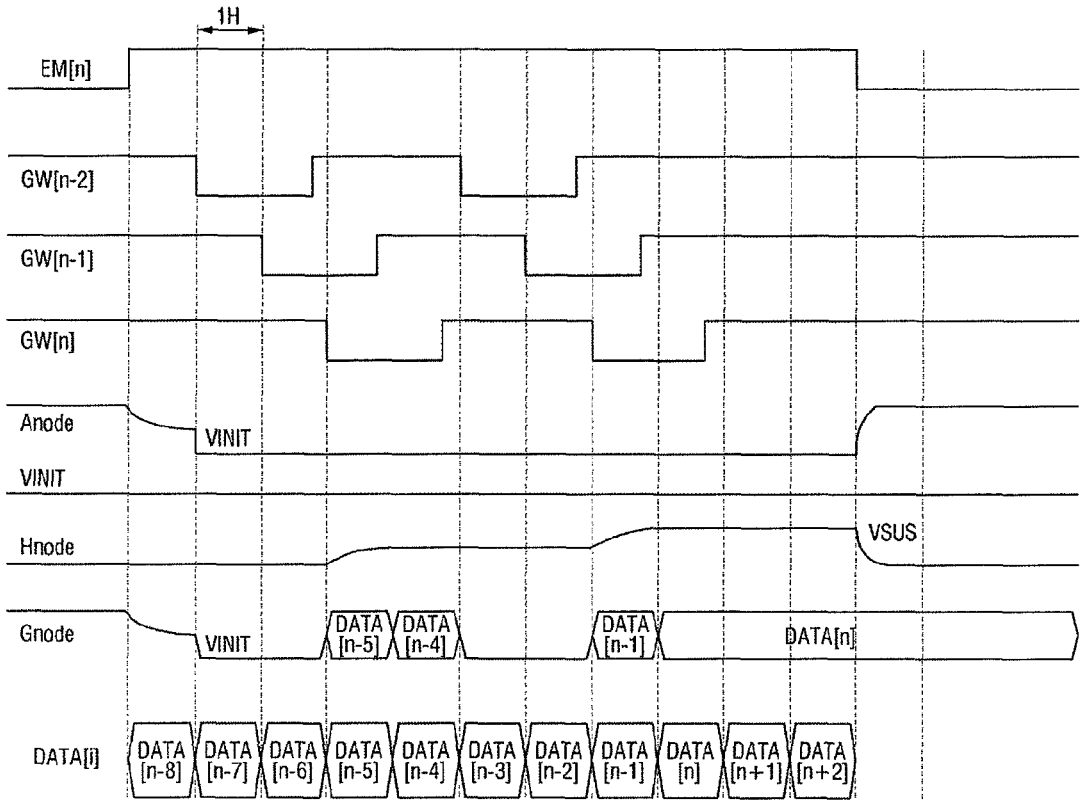
FIG. 9 illustrates another operation timing embodiment of a display device.

FIG. 8 illustrates an equivalent circuit of another embodiment of a unit pixel, and FIG. 9 is a timing diagram illustrating the operation timing of the display device. A display device including the unit pixel of this embodiment may have the same components as the display device 1000 of FIGS. 2 and 3, except that an initialization voltage line may be included. The display device may be an organic light-emitting display or another type of display device.

Referring to FIG. 8, an in-pixel circuit IPX of the display device according to the current embodiment may be connected to a data line extending in a first direction (e.g., a column direction) and the initialization voltage line extending along the first direction and separated from the data line. An out-pixel circuit OPX may be connected to a compensation power supply line VSUS extending along the first direction and separated from the data line.

Signals transmitted to the display device may include a first scan signal GW[n], a second scan signal GW[n−2], an emission control signal EM[n], a data signal (or voltage) DATA[i], a first power supply voltage ELVDD, a second power supply voltage ELVSS, a compensation voltage VSUS, and an initialization voltage VINIT.

A fourth TFT T4 may have a gate electrode receiving the second scan signal GW[n−2], a source electrode receiving the initialization voltage VINIT, and a drain electrode electrically connected to a drain electrode of a third TFT T3 and an anode of an organic light-emitting diode OLED at Anode. The fourth TFT T4 may be turned on by the second scan signal GW[n−2] to deliver the initialization voltage VINIT to the anode of the organic light-emitting diode OLED. Accordingly, electric charges in a capacitor of the organic light-emitting diode OLED may be removed, thereby preventing weak light emission due to a leakage current.

A fifth TFT T5 may have a gate electrode receiving the second scan signal GW[n−2], a source electrode receiving the initialization voltage VINIT, and a drain electrode connected to Gnode to remove electric charges from a storage capacitor Cst. Accordingly, a voltage corresponding to the data signal DATA[i] may be delivered to a gate electrode of a first TFT T1.

The initialization voltage VINIT may have a lower value than the second power supply voltage ELVSS. However, the initialization voltage VINIT may have the same value as the second power supply voltage ELVSS in another embodiment.

Referring to FIG. 9, while the emission control signal EM[n] has a high-level voltage, the first scan signal GW[n], the second scan signal GW[n−2], and a third scan signal GW[n−1] may be transmitted. The first scan signal GW[n] has been shifted from the third scan signal GW[n−1] by 1H and shifted from the second scan signal GW[n−2] by 2H. Each scan signal may maintain a low-level voltage for a period shorter than 2H and may include a section that maintains a plurality of low-level voltages.

A level of a voltage applied to Anode gradually falls from when the emission control signal EM[n] rises to a high level. Then, the level of the voltage applied to Anode falls to the second power supply voltage ELVSS at a time when a voltage of the second scan signal GW[n−2] falls to a low level and is then maintained at the second power supply voltage ELVSS. The level of the voltage applied to Anode begins to rise from a time when the emission control signal EM[n] falls to a low level and is then maintained at a constant level.

The initialization voltage VINIT may be lower than the second power supply voltage ELVSS and may maintain a certain magnitude.

Each scan signal may be maintained for 2H to charge the storage capacitor Cst without a falling delay. This method may be advantageous in terms of charging time, and therefore may be suitable for a large RC delay application.

Gnode is initialized to a low voltage such as the second power supply voltage ELVSS, and first and second data voltages DATA[n−5] and DATA[n−4] are applied to Gnode. The voltage of Gnode falls again to the second power supply voltage ELVSS in response to an ON bias, and then a third data voltage DATA[n−1] is applied to Gnode. Accordingly, hysteresis of the first TFT T1 may be restored and the data voltage DATA[i] may be finally stored.

Figure 10:
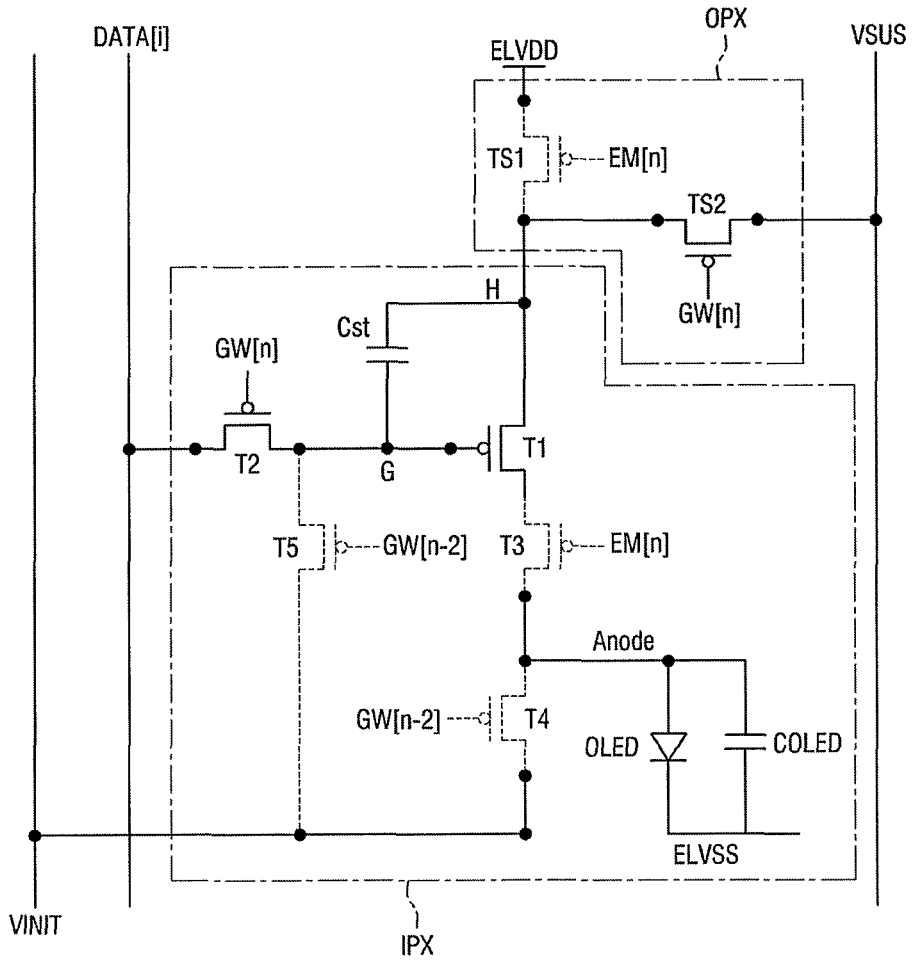
FIGS. 10 and 11 illustrate an example of the operation of the circuit of FIG. 8.
Figure 11:
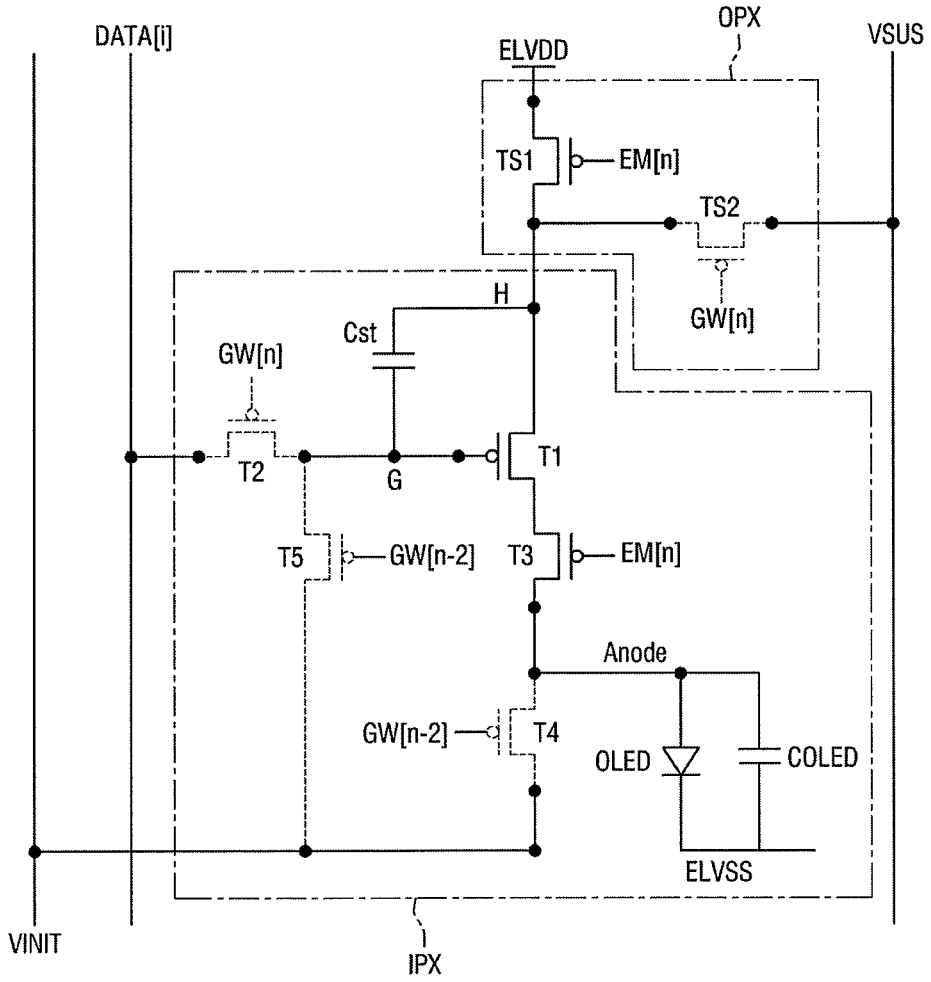

FIGS. 10 and 11 illustrating an example of the operation of the circuit of FIG. 8.

Referring to FIG. 10, when the voltage level of the emission control signal EM[n] rises to a high level and when the voltage level of the first scan signal GW[n] falls to a low level, the third through fifth TFTs T3 through T5 and a first compensation transistor TS1 are turned off.

A second TFT T2 is turned on in response to the first scan signal GW[n] to provide the data signal DATA[i] to Gnode, and a voltage corresponding to the data signal DATA[i] is stored in in the storage capacitor Cst connected to Gnode. A second compensation transistor TS2 is also turned on in response to the first scan signal GW[n] to apply the compensation voltage VSUS to Hnode. The voltage stored in the storage capacitor Cst may correspond to a difference (VSUS−DATA[i]) between the compensation voltage VSUS and the data voltage DATA[i].

Referring to FIG. 11, when the voltage level of the emission control signal EM[n] falls to a low level and when the voltage level of the first scan signal GW[n] rises to a high level, the second, fourth, and fifth TFTs T2, T4 and T5 and the second compensation transistor TS2 are turned off. As the third TFT T3 is turned on, a driving current of the first TFT T1 is delivered to the anode of the organic light-emitting diode OLED. Accordingly, the organic light-emitting diode OLED emits light.

However, as the first compensation transistor TS1 is turned on, the voltage of Hnode is changed to the first power supply voltage ELVDD, and the voltage of Gnode is also changed according to the first power supply voltage ELVDD. Therefore, an IR drop of the first power supply voltage ELVDD can be compensated for. The fourth TFT T4 and the fifth TFT T5 are turned on before a data write operation to remove electric charges from an organic light-emitting diode capacitor COLED connected to the storage capacitor Cst and Anode.

Figure 12:
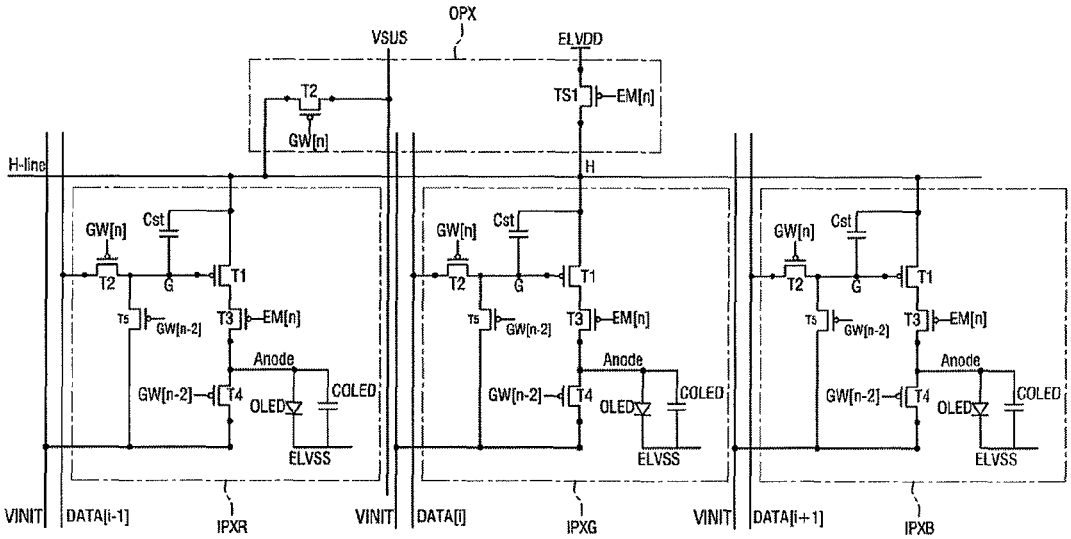
FIG. 12 illustrates another embodiment of a unit pixel.

FIG. 12 illustrates an equivalent circuit of another embodiment of a unit pixel of the display device. Referring to FIG. 12, a unit pixel of the display device according to the current embodiment may include R, G and B pixels.

An H line may extend in the first direction of the unit pixel and may be electrically connected to in-pixel circuits IPXR, IPXG and IPXB of the R, G, and B pixels. The H line passes through a plurality of unit pixels, and one out pixel OPX may be included in each unit pixel. The out pixel OPX may be formed in one or more subpixels (e.g., R, G, B and W pixels) in another embodiment.

Since the H line and a line to which the first power supply voltage ELVDD is applied have different electric potentials, they should be separated from each other. During data writing, the storage capacitor Cst should be charged while an IR drop of the first power supply voltage ELVDD is compensated. Therefore, to secure a sufficient charging time, a scan signal having a charging duration of 2H may be transmitted a plurality of times.

The first compensation transistor TS1 may have a gate electrode receiving the emission control signal EM[n], a source electrode receiving the first power supply voltage ELVDD, and a drain electrode connected to the source electrode of the first TFT T1 and a drain electrode of the second compensation transistor TS2 at Hnode. The first compensation transistor TS1 may apply the first power supply voltage ELVDD to Hnode in response to the emission control signal EM[n].

The second compensation transistor TS2 may have a gate electrode receiving the first scan signal GW[n], a source electrode receiving the compensation voltage VSUS, and the drain electrode connected to the source electrode of the first TFT T1 and the drain electrode of the first compensation transistor TS1 at Hnode. The first compensation transistor TS1 and the second compensation transistor TS2 may be separated from each other by a certain distance in order for easier layout design between pixels.

Figure 13:
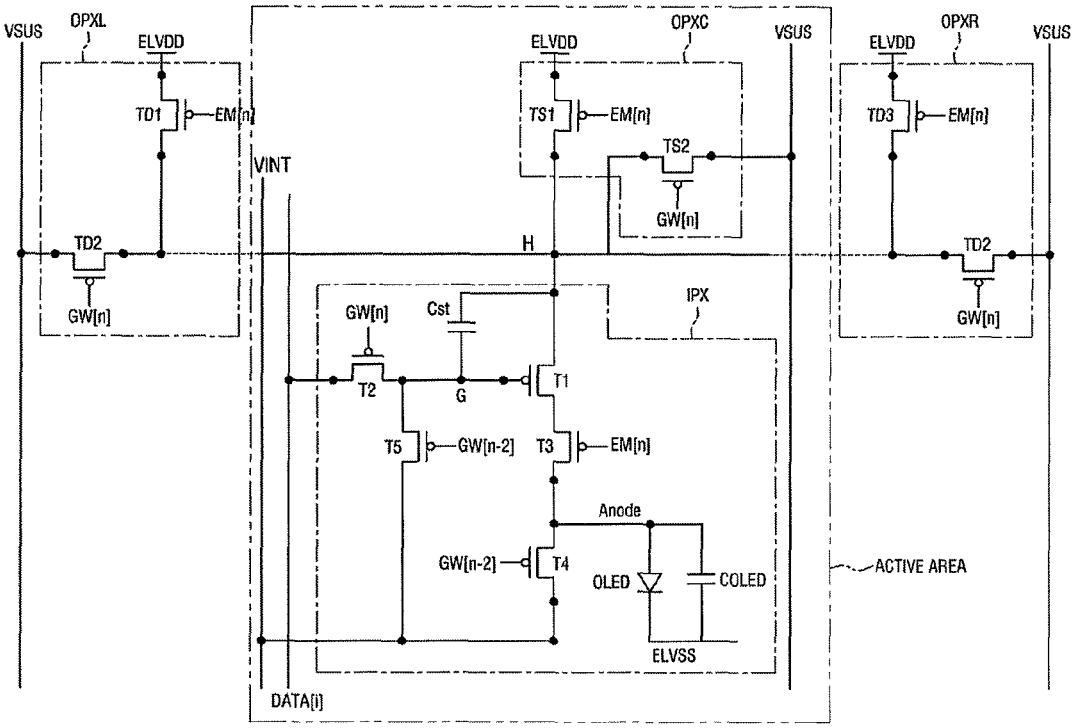
FIG. 13 illustrates another embodiment of compensation power supply lines and a unit pixel.

FIG. 13 illustrates a circuit diagram of another embodiment of compensation power supply lines and a unit pixel of the display device. Referring to FIG. 13, a first out pixel OPXL and a second out pixel OPXR electrically connected to the H line may be located on both sides of a panel of the display device.

The first out pixel OPXL may include a third compensation transistor TD1, which applies the first power supply voltage ELVDD to the H line in response to the emission control signal EM[n], and a fourth compensation transistor TD2 which applies the compensation voltage VSUS to the H line in response to the first scan signal GW[n].

The second out pixel OPXR may include a fifth compensation transistor TD3, which applies the first power supply voltage ELVDD to the H line in response to the emission control signal EM[n], and a sixth compensation transistor TD4 which applies the compensation voltage VSUS to the H line in response to the first scan signal GW[n]. By adding the first out pixel OPXL and the second out pixel OPXR to both sides of the H line, the compensation voltage VSUS may be applied more efficiently to the H line.

Figure 14:
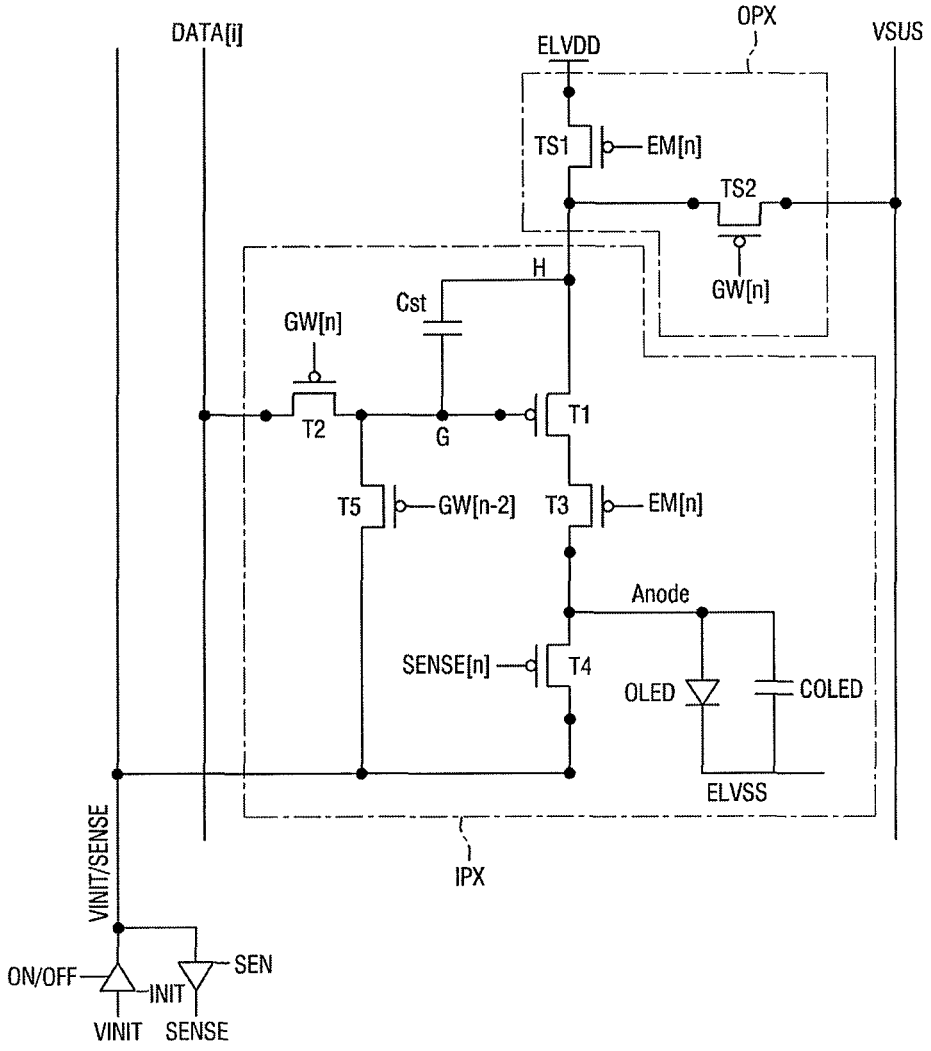
FIG. 14 illustrates another embodiment of a unit pixel.
Figure 15:
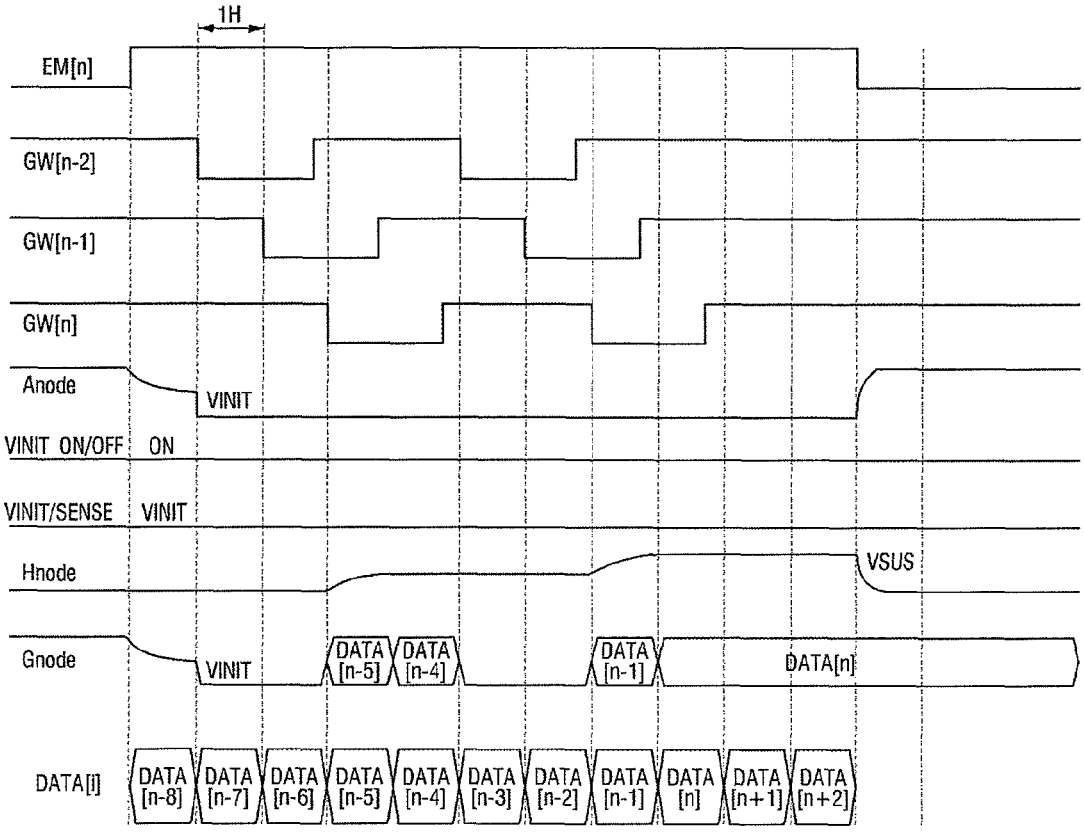
FIG. 15 illustrates another operation timing embodiment of a display device.

FIG. 14 illustrates an equivalent circuit of another embodiment of a unit pixel of a display device. FIG. 14 and FIG. 15 (to be described below) are similar to FIGS. 8 and 9, and thus a description of redundant components will be omitted. The display device may be an organic light-emitting display or another type of display.

Referring to FIG. 14, an in-pixel circuit IPX of the display device may be connected to a data line extending along a first direction (e.g., a column direction) and an initialization voltage line extending along the first direction and separated from the data line. An out-pixel circuit OPX may be connected to a compensation power supply line VSUS extending along the first direction and separated from the data line.

An initialization switching element INIT and a sensing element SEN may be connected to the initialization voltage line. Whether an initialization voltage VINIT may be applied to a source electrode of a fourth TFT T4 may be determined based on a signal (ON or OFF) transmitted to the initialization switching element INIT.

When a turn-on signal ON is transmitted to the initialization switching element INIT, most of electric current may flow through the fourth TFT T4 flows to the initialization switching element INIT and the sensing element SEN may not accurately measure the magnitude of a driving current.

When a turn-off signal OFF is transmitted to the initialization switching element INIT, the driving current of a pixel which flows through the fourth TFT T4 may flow to the sensing element SEN. Thus, the degree of degradation of an individual element may be accurately measured by accurately measuring the magnitude of the driving current. Operation principles when an organic light-emitting diode OLED according to the current embodiment emits light will be described with reference to FIG. 15.

FIG. 15 is a timing diagram illustrating an operation timing embodiment of the display device including the unit pixel of FIG. 14. Referring to FIG. 15, while an emission control signal EM[n] maintains a high-level voltage, each of a first scan signal GW[n], a second scan signal GW[n−2], and a third scan signal GW[n−1] may have a gate-on voltage (i.e., a low-level voltage). The first scan signal GW[n] has been shifted from the third scan signal GW[n−1] by 1H and shifted from the second scan signal GW[n−2] by 2H.

The gate-on voltage of each scan signal may be maintained for a period shorter than 2H and may have a section that maintains a plurality of low-level voltages. The gate-on voltage of each scan signal may be maintained for 2H to prevent a reduction in the charging rate of a storage capacitor Cst due to an RC delay.

In addition, the gate-on voltage of each of the first scan signal GW[n], the second scan signal GW[n−2], and the third scan signal GW[n−1] may be maintained for less than 2H to remove an overlap section between the first scan signal GW[n] and the second scan signal GW[n−2], thereby improving the charging rate of the storage capacitor Cst.

A sensing signal SENSE may be provided in order to determine the degree of degradation of a first TFT T1. However, since the amount of driving current may not be sensed at the same as an emission operation of the organic light-emitting diode OLED, the sensing signal SENSE may maintain a low-level voltage while the emission control signal EM[n] maintains a high-level voltage. During a time when a sensing operation is not performed, the sensing signal SENSE may play the role of applying the initialization voltage VINIT to Anode. In addition, while the emission control signal EM[n] maintains a low-level voltage, the sensing signal SENSE may maintain a high-level voltage, thus preventing a loss of the driving current provided to Anode.

As the emission control signal EM[n] rises to a gate-off voltage (i.e., a high-level voltage), a third TFT T3 is turned off, and thus the driving current is not provided. Accordingly, the voltage level of Anode falls gradually. The voltage level of Anode falls to the level of the initialization voltage VINIT by the fourth TFT T4 that is turned on in response to the sensing signal SENSE.

Even if the fourth TFT T4 is turned off because the sensing signal SENSE rises to a high level, the voltage level of Anode is maintained at the level of the initialization voltage VINIT until the third TFT T3 is turned on in response to the emission control signal EM[n]. Then, the voltage level of Anode rises to a voltage higher than the second power supply voltage ELVSS at a time when the emission control signal EM[n] falls to a low-level voltage.

Gnode is initialized to a low voltage such as the second power supply voltage ELVSS. Then, first and second data voltages DATA[n-5] and DATA[n-4] are applied to Gnode. The voltage of Gnode falls again to the second power supply voltage ELVSS in response to an ON bias, and then a third data voltage DATA[n−1] is applied to Gnode. Accordingly, hysteresis of the first TFT T1 may be restored and a data voltage DATA[i] may be finally stored.

Figure 16:
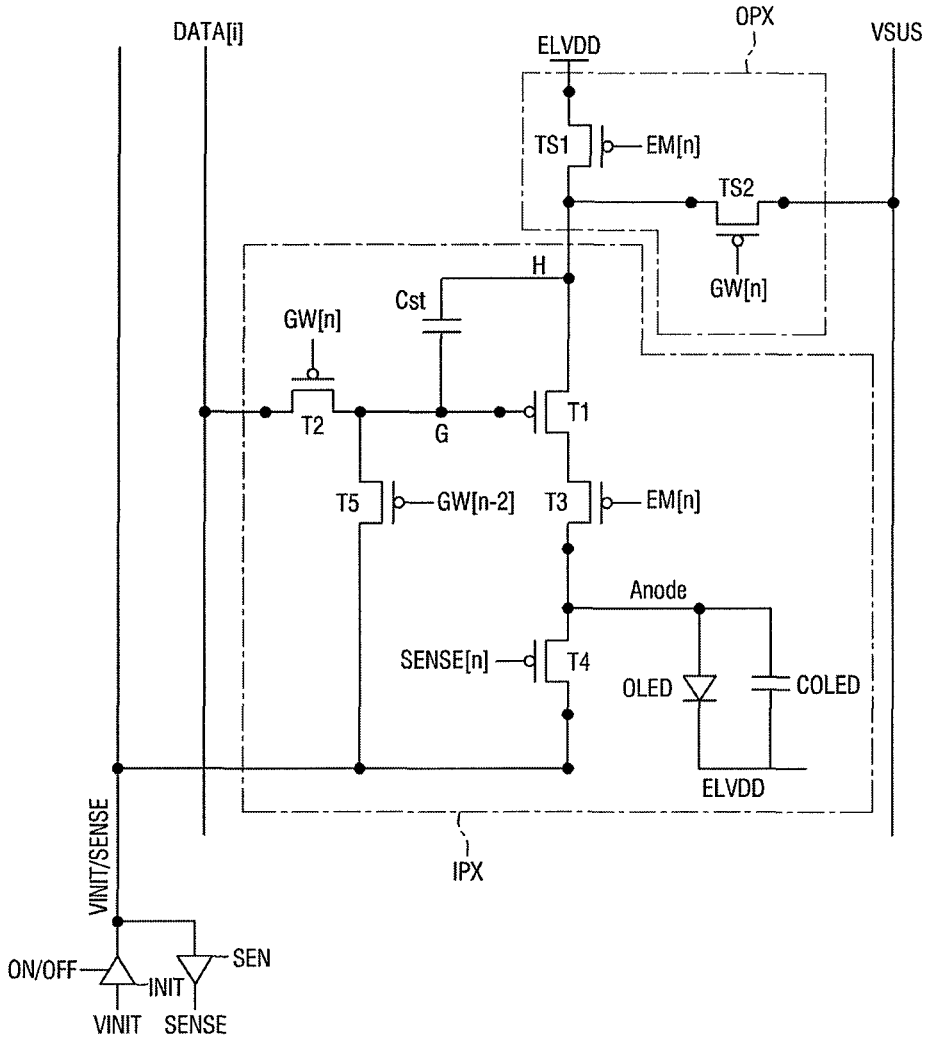
FIG. 16 illustrates another embodiment of a unit pixel.
Figure 17:
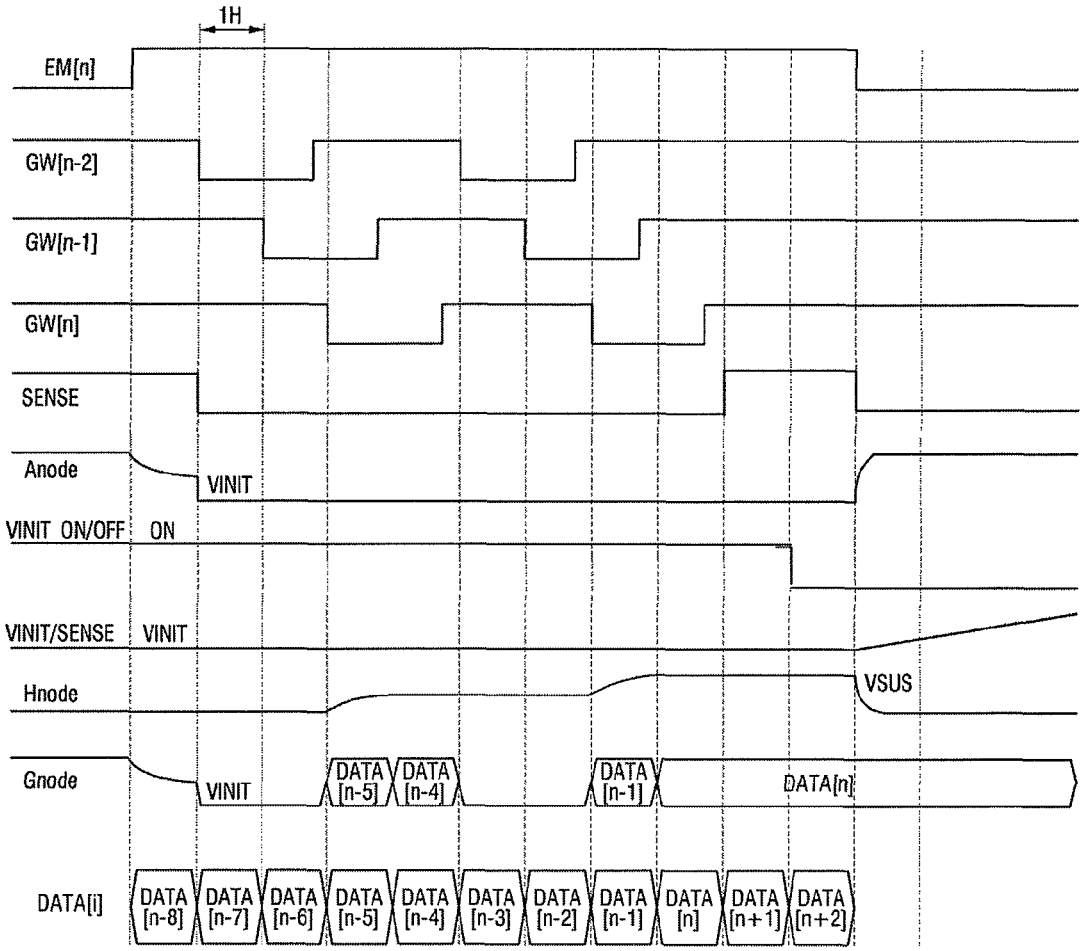
FIG. 17 illustrates an operation timing embodiment of the circuit of FIG. 16.

FIG. 16 illustrates an equivalent circuit of another embodiment of a unit pixel of a display device. FIG. 16 and FIG. 17 (to be described below) are similar to FIGS. 14 and 15, and thus a redundant description thereof will be omitted.

Referring to FIG. 16, a turn-off signal OFF is transmitted to an initialization switching element INIT during a sensing operation so as to prevent the application of an initialization voltage VINIT to Anode. In addition, a second power supply voltage ELVSS is changed to a first power supply voltage ELVDD during the sensing operation so as to prevent the introduction of an electric current to an organic light-emitting diode OLED.

The sensing operation may differ when a third TFT T3 is turned off and when the third TFT T3 is turned on. When the third TFT T3 is turned off, the amount of leakage current of the third TFT T3 can be measured. When the third TFT T3 is turned on, the amount of driving current of a first TFT T1 may be measured. Therefore, the degree of degradation of the first TFT T1 may be sensed. Driving principles during the sensing operation according to the current embodiment will be described with reference to FIG. 17.

FIG. 17 is a timing diagram illustrating the operation timing of the unit pixel of FIG. 16. Referring to FIG. 17, a sensing signal SENSE may be provided in order to determine the degree of degradation of the first TFT T1. However, since the amount of driving current cannot be sensed at the same as an emission operation of the organic light-emitting diode OLED, the sensing signal SENSE may maintain a low-level voltage while an emission control signal EM[n] maintains a high-level voltage. When the emission control signal EM[n] falls to a low-level voltage, the sensing signal SENSE may also fall to a gate-on voltage (i.e., a low-level voltage), thus providing the driving current to a sensor SEN.

During a sensing operation, the turn-off signal OFF may be transmitted to the initialization switching element INT so as to prevent the introduction of the driving current to a terminal to which the initialization voltage VINIT is applied. Thus, a signal transmitted to the initialization switching element INT may be changed to the turn-off signal OFF before a low-level voltage is applied as the sensing signal SENSE.

A level of a voltage applied to Anode begins to fall gradually at a time when the emission control signal EM[n] rises to a high level and falls to the level of initialization voltage VINIT by a fourth TFT T4 that is turned on in response to the sensing signal SENSE. Even if the fourth TFT T4 is turned off because the sensing signal SENSE rises to a high level, the level of the voltage applied to Anode is maintained at the level of the initialization voltage VINIT until the third TFT T3 is turned on in response to the emission control signal EM[n]. Then, the level of the voltage applied to Anode rises to a voltage higher than the second power supply voltage ELVSS at a time when the emission control signal EM[n] falls to a low-level voltage.

Gnode is initialized to a low voltage such as the second power supply voltage ELVSS. Then, first and second data voltages DATA[n-5] and DATA[n-4] are applied to Gnode. The voltage of Gnode falls again to the second power supply voltage ELVSS in response to an ON bias, and then a third data voltage DATA[n−1] is applied to Gnode. Accordingly, hysteresis of the first TFT T1 may be restored and a data voltage DATA[i] may be finally stored.

The initialization switching element INT operates typically during light emission. However, when external characteristics (e.g., external light or panel temperature) are received through a sensing line, the ON or OFF of the initialization switching element INT may be controlled to compensate for the external characteristics.

Signals transmitted to the display device may include a first scan signal GW[n], a second scan signal GW[n−2], the emission control signal EM[n], the data signal DATA[i], the first power supply voltage ELVDD, the second power supply voltage ELVSS, a compensation voltage VSUS, the initialization voltage VINIT, and the sensing signal SENSE[n].

Figure 18:
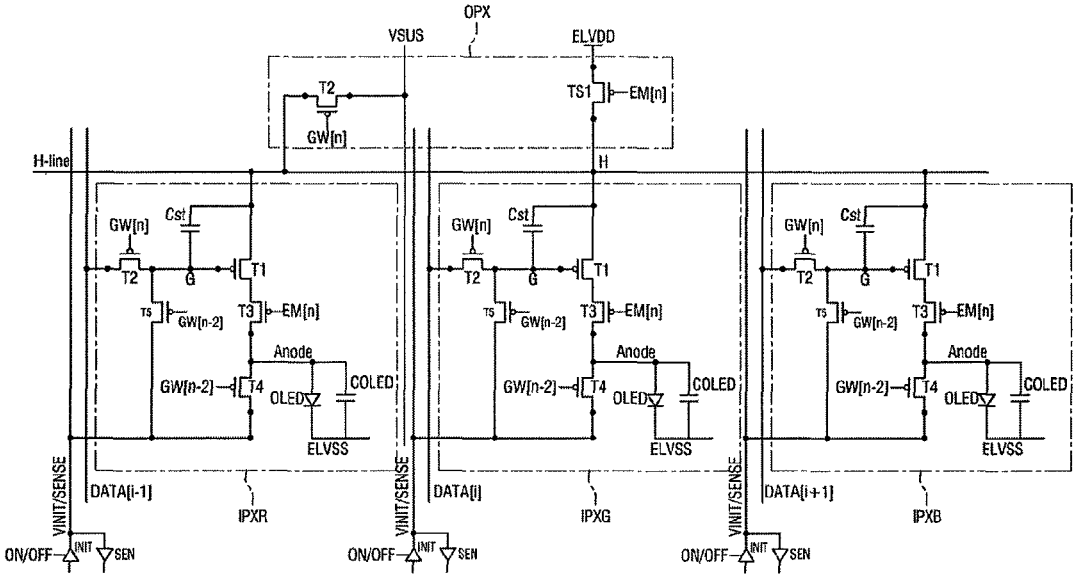
FIG. 18 illustrates another embodiment of a compensation power supply line and a unit pixel.

FIG. 18 illustrates an equivalent circuit of another embodiment of a compensation power supply line and a unit pixel of a display device. FIG. 18 is similar to FIG. 12, and thus a redundant description thereof will be omitted.

Referring to FIG. 18, an H line may extend along a first direction of a unit pixel and may be electrically connected to in-pixel circuits IPXR, IPXG and IPXB of the R, G and B pixels. The H line passes through a plurality of unit pixels, and one out pixel OPX may be included in each unit pixel. The out pixel OPX may be formed in one or more subpixels (e.g., R, G, B and W pixels) in another embodiment.

An in-pixel circuit IPX may be connected to a data line extending in the first direction (e.g., a column direction) and an initialization voltage line extending in the first direction and separated from the data line. The out-pixel circuit OPX may be connected to a compensation power supply line VSUS extending in the first direction and separated from the data line.

An initialization switching element INIT and a sensing element SEN may be connected to the initialization voltage line. Whether an initialization voltage VINIT may be applied to a source electrode of a fourth TFT T4 may be determined based on a signal (ON or OFF) transmitted to the initialization switching element INIT.

Figure 19:
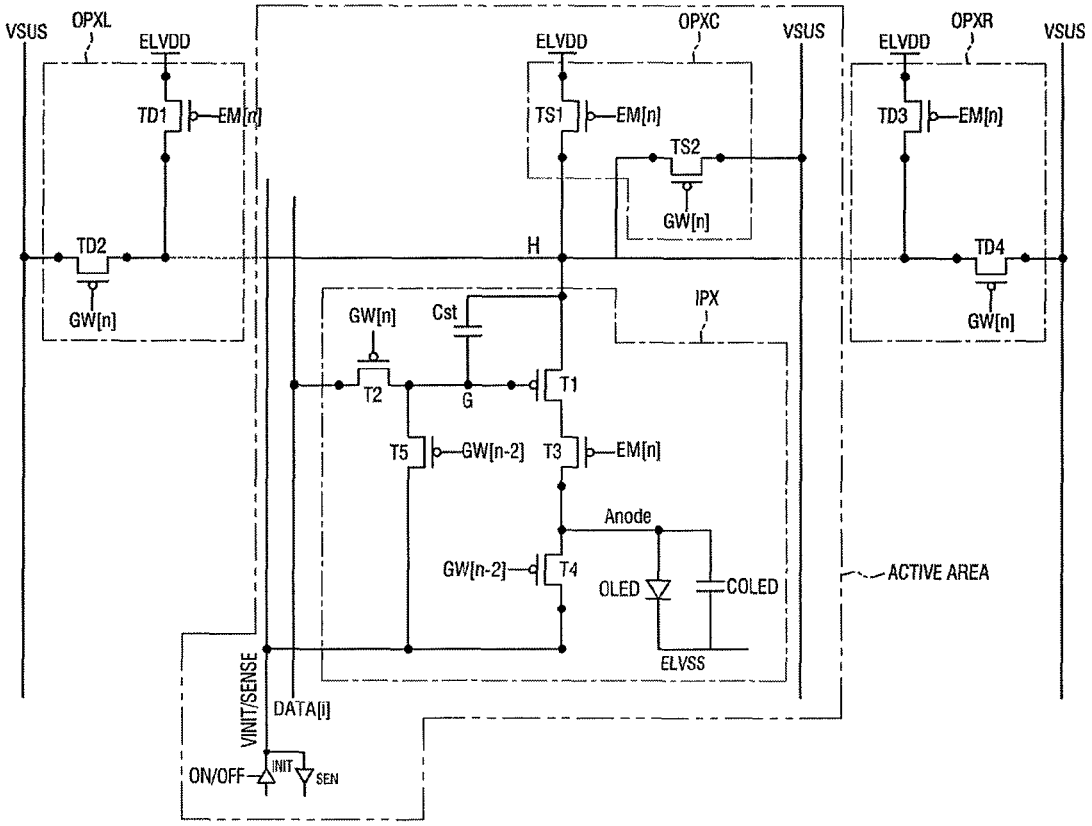
FIG. 19 illustrates another embodiment of a compensation power supply line and a unit pixel.

FIG. 19 illustrates an equivalent circuit of another embodiment of compensation power supply lines formed at both ends of a panel of a display device and a unit pixel of the display device. FIG. 19 is similar to FIG. 13, and thus a redundant description thereof will be omitted.

Referring to FIG. 19, a first out pixel OPXL and a second out pixel OPXR electrically connected to an H line may be located at both ends of the panel of the display device. By adding the first out pixel OPXL and the second out pixel OPXR to both sides of the H line, a compensation voltage VSUS may be applied more efficiently to the H line.

An in-pixel circuit IPX may be connected to a data line extending in a first direction (e.g., a column direction) and an initialization voltage line extending in the first direction and separated from the data line. An out-pixel circuit OPX may be connected to a compensation power supply line VSUS extending in the first direction and separated from the data line.

An initialization switching element INIT and a sensing element SEN may be connected to the initialization voltage line. Whether an initialization voltage VINIT can be applied to a source electrode of a fourth TFT T4 may be determined based on a signal (ON or OFF) transmitted to the initialization switching element INIT.

By way of summation an review, the threshold voltage of a driving transistor may change, for example, based on various manufacturing process variables. Therefore, it may be difficult to manufacture driving transistors having equal threshold voltages in an active matrix display. This will result in a threshold voltage difference among the pixels.

One method of compensating for a difference in threshold voltages among pixels utilizes a pixel structure in which a current source adjusts a voltage between a source and a gate of a driving transistor with respect to an overdrive voltage of the driving transistor, and compensates for a deviation in the threshold voltage of the driving transistor. However, this method requires two operations, i.e., a data wiring operation and a continuous light emission operation. The current source adjusts the voltage between the source and the gate of the driving transistor with respect to the overdrive voltage and compensates for a deviation in the threshold voltage of the driving transistor.

Also, current-driven display devices include EL elements that are driven according to data signals at levels of an electric current supplied from a current source. As a result, it may be difficult to charge the data lines of such a device. For example, parasitic capacitance of the data lines may be relatively large, and the current level of each data signal provided from the current source may be relatively small. Therefore, a considerably long time may be required to charge the data line. Data may become unstable under these circumstances.

In accordance with one or more of the aforementioned embodiments, an insufficient charging time may be overcome and a stable data voltage may be applied by combining internal circuit compensation and external circuit compensation.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a plurality of data lines in a first direction;

a plurality of gate lines in a second direction;

a plurality of pixels at intersections of the data lines and gate lines; and a compensation power supply line in the first direction and separated from the data lines, wherein each of the pixels includes:

an in-pixel circuit including a first transistor, to be controlled based on a data voltage from a corresponding one of the data lines, and a storage capacitor connecting a gate electrode of the first transistor and a first node, and at least one out-pixel circuit to receive a compensation voltage from the compensation power supply line and to provide the compensation voltage to the first node.

2. The display device as claimed in claim 1, wherein the in-pixel circuit includes:

a second transistor to deliver the data voltage applied to the corresponding one of the data lines to a second node based on a first input signal;

a third transistor to apply a voltage of the first transistor and a voltage of a third node based on an emission control signal; and an organic light-emitting diode connected to the third node.

3. The display device as claimed in claim 2, wherein the in-pixel circuit includes:

a fourth transistor to apply a power supply voltage to the third node based on a second input signal; and a fifth transistor to apply the power supply voltage to the second node based on to the second input signal.

4. The display device as claimed in claim 3, wherein a phase of the first input signal is later than a phase of the second input signal by substantially two horizontal periods.

5. The display device as claimed in claim 2, wherein the at least one out-pixel circuit includes:

a first compensation transistor to provide a pixel power supply voltage to the first node in response to the emission control signal; and a second compensation transistor to deliver the compensation voltage applied to the compensation power supply line to the first node.

6. The display device as claimed in claim 1, further comprising:

a unit pixel including two or more of the pixels; and a horizontal line in the second direction and electrically connected to the unit pixel.

7. The display device as claimed in claim 6, wherein the unit pixel includes compensation power supply line and one of the out-pixel circuit.

8. The display device as claimed in claim 1, further comprising:

a horizontal compensation line in the second direction and electrically connected to the unit pixel; and a first out-pixel circuit and a second out-pixel circuit at ends of the horizontal compensation line and connected to the compensation power supply line.

9. The display device as claimed in claim 8, wherein:

the first out-pixel circuit includes a third compensation transistor to provide the compensation voltage applied to the compensation power supply line to the horizontal compensation line based on the first input signal, and the second out-pixel circuit includes a fourth compensation transistor to provide the compensation voltage applied to the compensation power supply line to the horizontal compensation line based on the first input signal.

* * * * *